US006279166B1

(12) United States Patent
Schild

(10) Patent No.: US 6,279,166 B1
(45) Date of Patent: Aug. 28, 2001

(54) GLOVE WITH INSERTS ON THE FINGER PORTIONS

(76) Inventor: Shawn Schild, 719 W. Pacific St., Blackfoot, ID (US) 83221

( * ) Notice: Subject to any disclaimer, the term of this patent is extended or adjusted under 35 U.S.C. 154(b) by 0 days.

(21) Appl. No.: 09/585,451

(22) Filed: Jun. 1, 2000

(51) Int. Cl.[7] ..... A41D 19/00
(52) U.S. Cl. ..... 2/163; 2/160
(58) Field of Search ..... 2/16, 21, 159, 2/160, 161.1, 161.4, 161.5, 161.6, 163, 167

(56) References Cited

U.S. PATENT DOCUMENTS

| | | | | |
|---|---|---|---|---|
| 3,997,922 | | 12/1976 | Huhta . | |
| 4,494,249 | | 1/1985 | Hansson . | |
| 4,561,122 | * | 12/1985 | Stanley et al. | 2/20 |
| 4,654,896 | | 4/1987 | Rinehart . | |
| 4,930,162 | | 6/1990 | Cote . | |
| 5,323,490 | | 6/1994 | Yarbrough | 2/160.7 |
| 5,488,739 | | 2/1996 | Cardinal | 2/161.1 |
| 5,768,711 | * | 6/1998 | Wissink | 2/161.1 |
| 5,857,216 | | 1/1999 | Gold | 2/169 |
| 5,881,388 | * | 3/1999 | Pratt | 2/163 |
| 5,987,646 | | 11/1999 | Bolmer | 2/161.1 |

FOREIGN PATENT DOCUMENTS

| | | | |
|---|---|---|---|
| 2114125 | 11/1970 | (FR) | 2/163 |

* cited by examiner

*Primary Examiner*—John J. Calvert
*Assistant Examiner*—Katherine Moran
(74) *Attorney, Agent, or Firm*—Tom Hamill, Jr.

(57) ABSTRACT

A glove having a pinky finger, ring finger, middle finger, index finger and thumb receiving portion in communication with a hand receiving portion is provided. The pinky finger, ring finger, middle finger and index finger receiving portions each have a top panel and a bottom panel, which are connected to form each of the finger receiving portions. Each finger receiving portion includes a distal region, an intermediate region, and a proximal region, the proximal region connected to the hand receiving portion, the distal region surrounding the fingertips and the intermediate region residing about the middle knuckle (proximal interphalangeal joint) of the hand. The intermediate region of each finger receiving portion includes a right and left insert, the insert being generally of a triangular shape and provided on the bottom panel. The inserts are sewn in the bottom panel after the bottom panel has been rotated to approximate the bending of the middle knuckle (proximal interphalangeal joint) of the finger. This permits the wearer to close his hand about an object without stretching the glove intermediate regions. This permits the wearer to tighten his grip with greater ease and increases the life expectancy of the glove.

9 Claims, 5 Drawing Sheets

GLOVE WITH INSERTS ON THE FINGER PORTIONS

BACKGROUND OF THE INVENTION

1. Field of the Invention

The present invention relates generally to leather gloves, and more particularly, to a leather glove with inserts located about the middle knuckle portion (proximal interphalangeal joint) of each digit especially adapted to effect the ease of bending the fingers within the glove.

2. Description of the Prior Art

Gloves which permit the flexing of the fingers are known in the art. U.S. Pat. No. 4,494,249 issued to Hansson shows a glove with a triangular cut made in the region proximal the metacarpophalangeal joint. This cut does not have any material affixed thereto, merely an opening. The cut exposes the knuckle joint to the environment.

U.S. Pat. No. 4,930,162 discloses a hockey glove having a lateral padded wart with split formed in the top panel of the fingers. The split in the top panel of the index finger includes an elastic insert made from lycra elastic material. The splits located in the other fingers are not covered with elastic material, and appear to merely be openings similar to those found on the '249 patent.

U.S. Pat. No. 5,857,162 discloses a glove which has elongated generally rectangular inserts located from about the metacarpophalangeal joint to about the middle phalanx. It appears as if the '162 glove finger receiving portion includes a top, bottom, right and left panel, with the inserts being included in the right and left panels. The instant invention does not have right and left panels and is quite structurally different than the '162 device.

Thus, while the foregoing body of prior art indicates it to be known to use cuts or slots to increase the flexibility of the motion of a joint, no prior art teaches the method of providing a generally triangular insert on the finger receiving portion about the proximal interphalangeal joint for the pinky, ring, middle and index finger. Nor does the prior art described above teach or suggest a first and second insert placed on the right and left side of the finger receiving portion about the proximal interphalangeal joint of the small (pinky), ring, middle and index finger respectively. Other advantages of the present invention over the prior art also will be rendered evident.

SUMMARY OF THE INVENTION

To achieve the foregoing and other advantages, the present invention, briefly described, provides a glove having a pinky finger, ring finger, middle finger, index finger and thumb receiving portion in communication with a hand receiving portion. The pinky finger, ring finger, middle finger and index finger receiving portions each have a top panel and a bottom panel, which are connected to form each of the finger receiving portions. Each finger receiving portion includes a distal region, an intermediate region, and a proximal region, the proximal region connected to the hand receiving portion, the distal region surrounding the fingertips and the intermediate region residing about the middle knuckle of the hand. The intermediate region of each finger receiving portion includes a right and left insert, the insert being generally of a triangular shape and provided on the bottom panel. The inserts are sewn in the bottom panel after the bottom panel has been rotated to approximate the bending of the middle knuckle. This permits the wearer to close his hand about an object without stretching the glove intermediate regions. This permits the wearer to tighten his grip with greater ease and increases the life expectancy of the glove.

In the manufacture of the glove finger portions, the bottom panel has a small triangular cut made in the intermediate region on both the right and left side. This cut may be made of one of any of several different geometries. The bottom panel is then rotated about between 30 and 60 degrees at the intermediate region to approximate the bending of the middle knuckle of the finger. A right and left insert is then sewn into the opening formed while the bottom panel is in the rotated position. The right and left inserts may have a generally triangular or sinusoidal configuration. Each insert has the general appearance of a triangle similar to a 90 degree, 45 degree, 45 degree triangle. The insert has a long side and two approximately equal shorter sides, these shorter sides converging on the 90 degree apex in a curvilinear fashion, giving a sinusoidal appearance. Each bottom panel of the finger receiving portion has a right and a left terminus. Each top panel of the finger receiving portion has a right and a left terminus. The top panel right terminus is sewn to the bottom panel right terminus. The top panel left terminus is sewn to the bottom panel left terminus. The right insert long side is co-linear with the bottom panel right terminus and is located at the intermediate portion thereon. The left insert long side is co-linear with the bottom panel left terminus and is located at the intermediate portion thereon. The right and left insert long side is therefore sewn to the top panel right and left terminus intermediate portion respectively. This configuration is repeated for the pinky finger receiving portion, the ring finger receiving portion, the middle finger receiving portion, the index finger receiving portion and in some cases the thumb receiving portion.

The right and left insert biases the intermediate region to approximate the position of the middle knuckle when the middle knuckle is in a bent position. The bottom panel is then returned to the neutral or straight finger position and then the top panel is sewn on both the right and left sides forming the finger receiving portion of the glove. This process is repeated for the pinky finger, ring finger, middle finger and index finger. In the instant invention, the inserts are not placed on the thumb, however, there may be certain situations when it would be desirable to do so and as such it is considered to be in the scope of the invention.

The top panels of the finger receiving portions proximal ends are integral with the hand top panel. The bottom panels of the pinky and index finger are integral with the palm panel. The middle finger and index finger bottom panels are affixed to the palm panel by conventional stitching.

The palm panel further includes the bottom element of the thumb receiving portion of the glove. A top element of the thumb receiving portion is attached to the palm panel, directly to the bottom element of the thumb receiving portion, the hand top panel, and a portion of the ring finger top panel.

The glove may be secured about the wrist by a flap which connects one side of the glove to the other with hook and loop fasteners. The glove may further have no such connection means and may simply fit atop the hand.

The hand top panel and the palm panel are sewn about the right and left sides forming the hand receiving portion of the glove. The finger and thumb receiving portions are then affixed to the hand receiving portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is an object of the present invention to provide a glove with a right and a left insert on the finger receiving portion of the ring, middle, index and pinky finger.

It is another object of the present invention to provide the aforementioned insert near or about the middle knuckle portion (proximal interphalangeal joint) of the ring, middle, index and pinky finger.

It is another object of the invention to provide a glove where there is no stretching of the finger material when the glove is clenched about an object.

It is another object of the invention to provide a glove which has a greater life span, due to the lack of cyclical stresses placed on the material about the middle knuckle portion (proximal interphalangeal joint) of the glove.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiment of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a glove with inserts on the finger portions embodying the principles and concepts of the present invention will be described.

Figure 1:
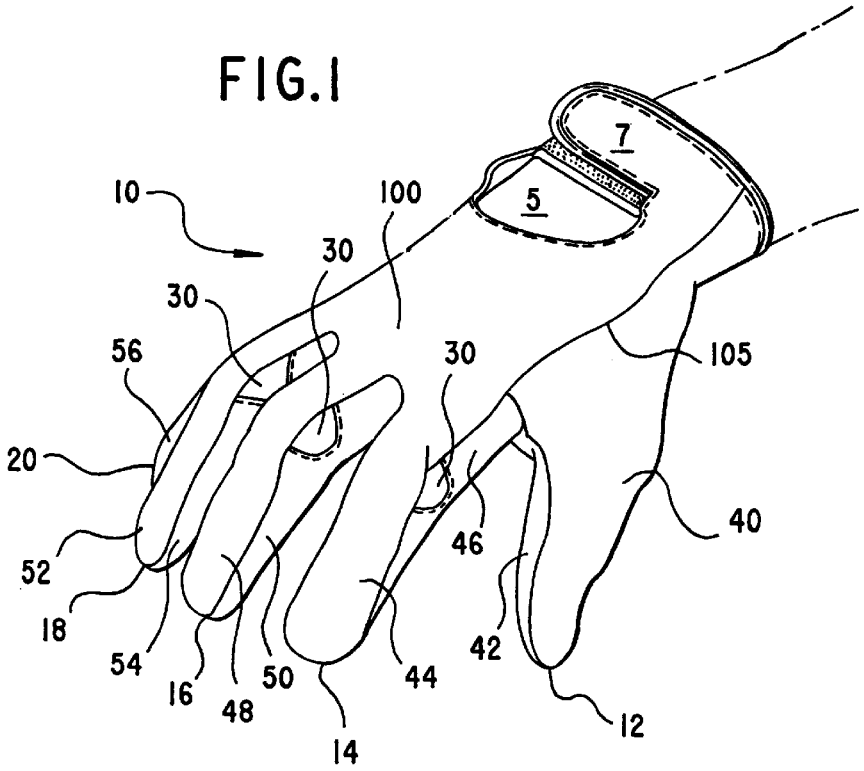
FIG. 1 is a view showing the glove with inserts, the glove being worn on the hand.
Figure 2:
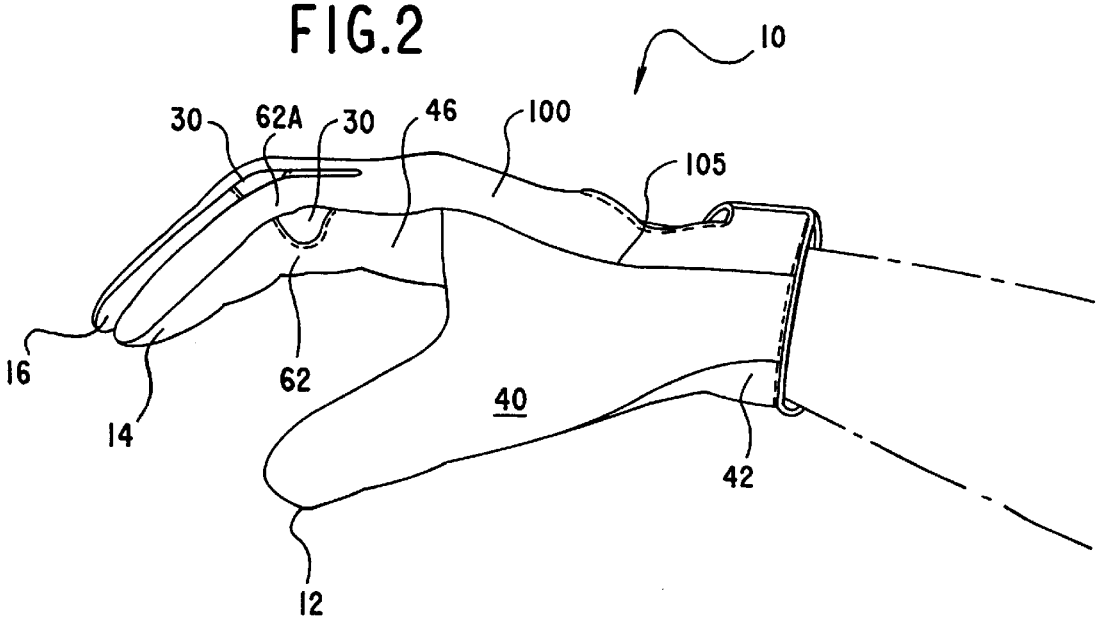
FIG. 2 is a side view of the glove with inserts, the glove being worn on the hand.
Figure 7:
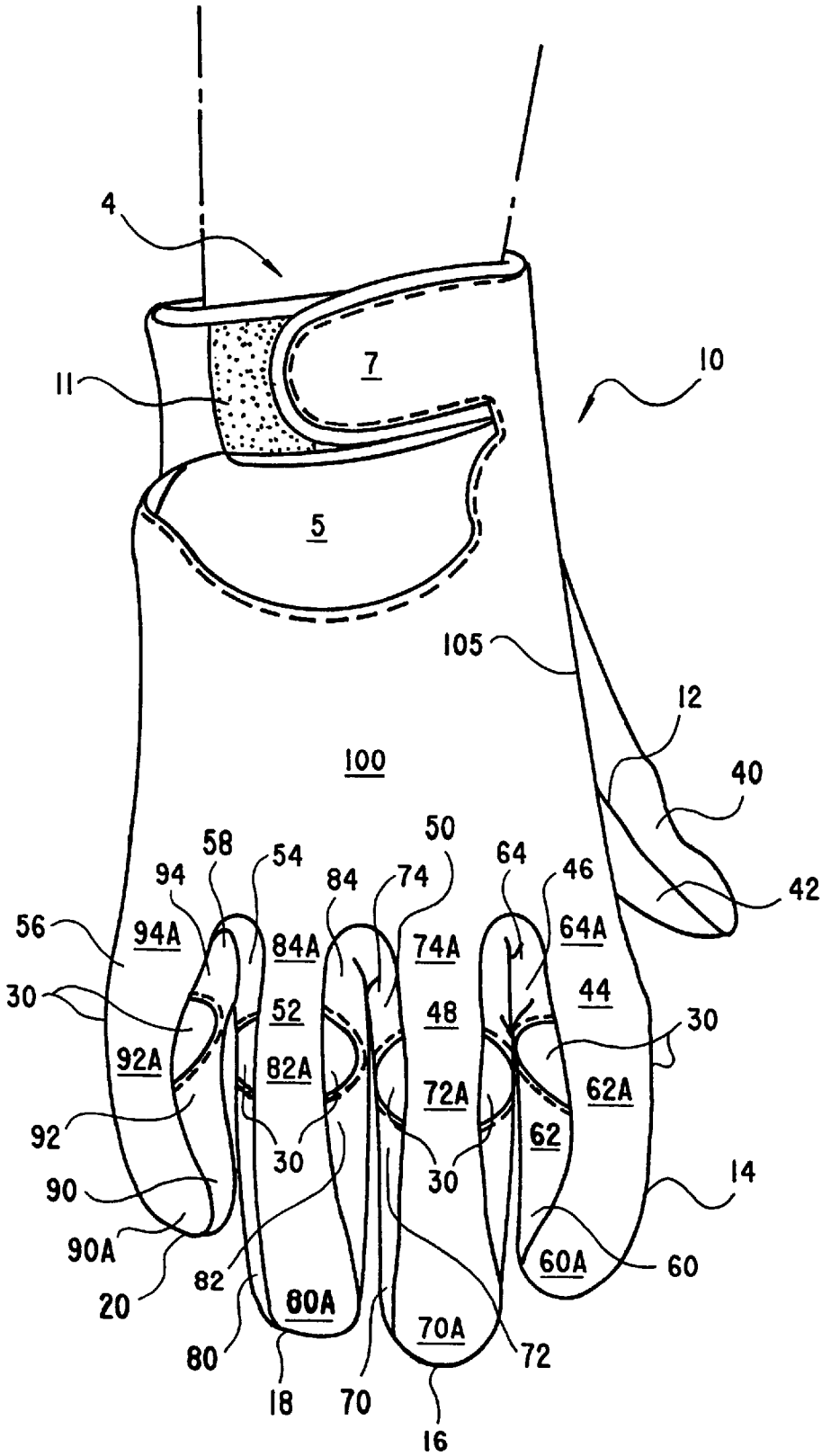
FIG. 7 is a top view of the glove with inserts.

Turning initially to FIGS. 1, 2 and 7, there is shown the glove with inserts 30 on the finger portions generally designated by reference numeral 10. In its preferred form, glove comprises generally a hand receiving portion 100, a thumb receiving portion 12, an index finger (or forefinger) receiving portion 14, a middle finger receiving portion 16, a ring finger receiving portion 18 and a pinky (or small) finger receiving portion 20. The glove 10 may include an opening 5 generally proximal the wrist 4, or may not have an opening at all. In certain embodiments, the glove 10 may be secured about the wrist 4 by flap 7, which may close about the wrist and be secured thereto by hook and loop fasteners 11 or other equivalent means.

The thumb receiving portion 12 includes a top panel 40 and a bottom panel 42. The thumb receiving portion top panel 40 and bottom panel 42 are sewn together and are connected to the hand receiving portion 100 about sew line 105.

The index finger receiving portion 14 includes a top panel 44 and a bottom panel 46. The index finger receiving portion 14 bottom panel 46 has a distal member 60, an intermediate member 62 and a proximal member 64. The index finger receiving portion 14 top panel 44 has a distal member 60A, an intermediate member 62A and a proximal member 64A. Incorporated on both the right and left sides of the bottom panel 46 intermediate member 62 is a flexor insert 30.

The middle finger receiving portion 16 includes a top panel 48 and a bottom panel 50. The middle finger receiving portion 16 bottom panel 50 has a distal member 70, an intermediate member 72 and a proximal member 74. The middle finger receiving portion 16 top panel 48 has a distal member 70A, an intermediate member 72A and a proximal member 74A. Incorporated on both the right and left sides of the bottom panel 50 intermediate member 72 is a flexor insert 30.

The ring finger receiving portion 18 includes a top panel 52 and a bottom panel 54. The ring finger receiving portion 18 bottom panel 54 has a distal member 80, an intermediate member 82 and a proximal member 84. The ring finger receiving portion 18 top panel 52 has a distal member 80A, an intermediate member 82A and a proximal member 84A. Incorporated on both the right and left sides of the bottom panel 54 intermediate member 82 is a flexor insert 30.

The pinky finger receiving portion 20 includes a top panel 56 and a bottom panel 58. The pinky finger receiving portion 20 bottom panel 58 has a distal member 90, an intermediate member 92 and a proximal member 94. The pinky finger receiving portion 20 top panel 56 has a distal member 90A, an intermediate member 92A and a proximal member 94A.

Incorporated on both the right and left sides of the bottom panel 58 intermediate member 92 is a flexor insert 30.

Figure 3:
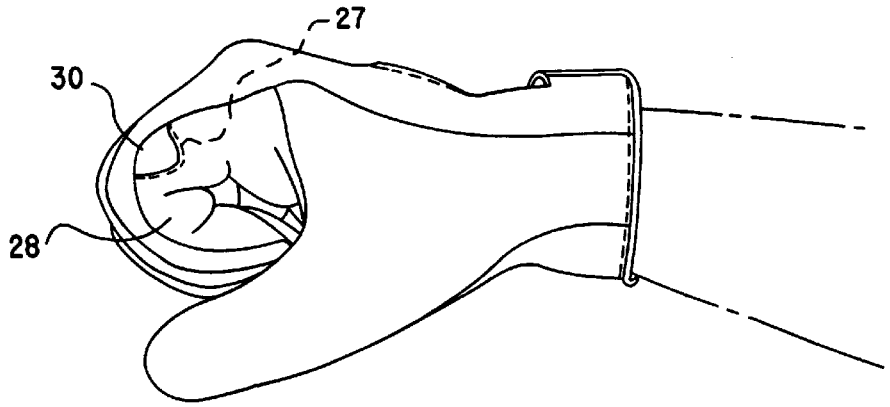
FIG. 3 is a view of the glove being worn on the hand with the hand clenched, with a cut away portion showing the finger in relation to the insert.

FIG. 3 shows the gloved hand in the clenched position, showing the proximal relationship between the flexor insert 30 and the middle knuckle 27 of the index finger 28. This general spatial relationship of insert 30 to knuckle holds for the other fingers as well. By including the flexor insert 30 on the right side and left side of the bottom portion of each finger receiving element, the top portion is not stretched when the hand is clenched about an object. This is due to the fact that the bottom portion of each finger receiving portion has more material than the top portion of each finger receiving portion, permitting the top portion to rotate without being held back or confined by the stitching of the lower portion. This increases the life time of the glove as the region just above the knuckles is the first region to fail due to repeated stresses.

Figure 4:
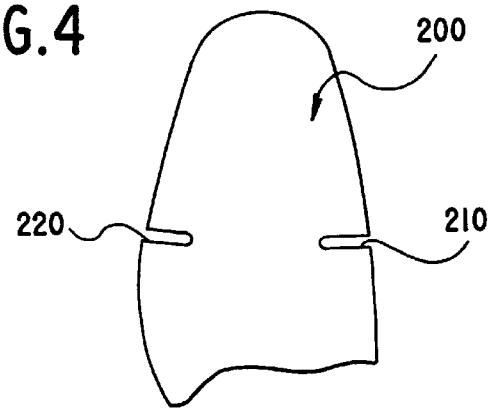
FIG. 4 is a view of the pattern used for the bottom panel of the index finger including the apertures designed to receive the inserts.
Figure 5A:
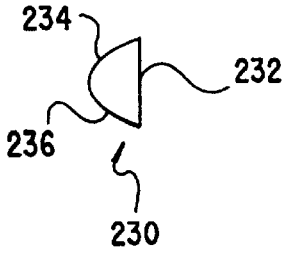
FIG. 5*a* is a view of a flexor insert.
Figure 5B:
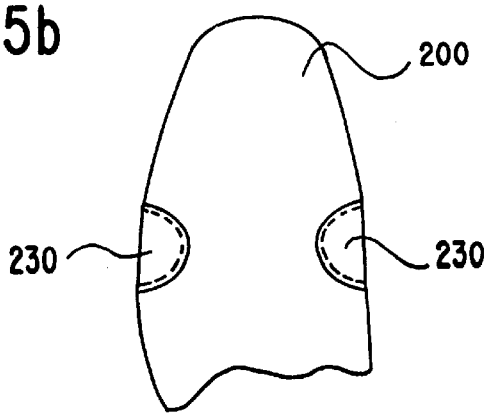
FIG. 5*b* is a view of the right and left inserts being sewn into the bottom panel of the index finger after the bottom panel has been bent to approximate the clenching of the finger.
Figure 5C:
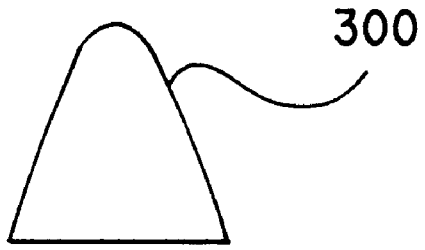
FIG. 5*c* shows a view of the flexor insert in a sinusoidal configuration.
Figure 5D:
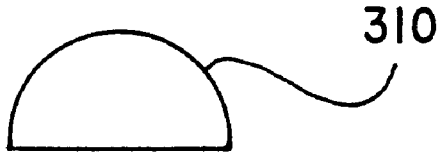
FIG. 5*d* shows a view of the flexor insert in a half-circular configuration.
Figure 5E:
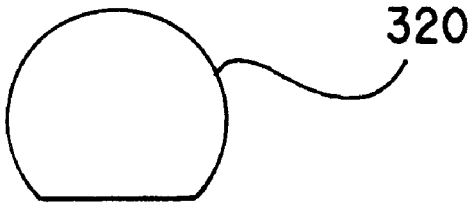
FIG. 5*e* shows a view of the flexor insert in a scalloped configuration.

Turning now to FIGS. 4, 5*a*, & 5*b* the manner of attachment of the flexor element in shown FIG. 4 shows a bottom portion 200 of any of the finger receiving portions, prior to the flexor insert being affixed. A right cut 210 and a left cut 220 are made in the bottom portion 200. The bottom portion is rotated downwardly, simulating the rotation of the knuckle when the hand is clenched. When in this position, both the right cut 210 and the left cut 220 elongate, and the flexor insert 230 is sewn onto both the right cut and the left cut, as shown in FIG. 5*b*. The bottom portion 200 is then relaxed to its normal position and sewed to the top portion forming one of any of the finger receiving portions. FIG. 5*a* shows the flexor insert 230. The flexor insert 230 has a generally rounded triangular configuration with a straight side 232 and a second side 234 and a third side 236. The flexor insert 230 may have other similar configurations including, but not limited to, a half circle 310, a sinusoidal portion 300, a rectangular element, a half-hexagonal element, a half octagonal element, a scalloped portion 320 etc. In the preferred form, the flexor insert 230 has a generally similar appearance to that shown in FIG. 5*a*.

Figure 6A:
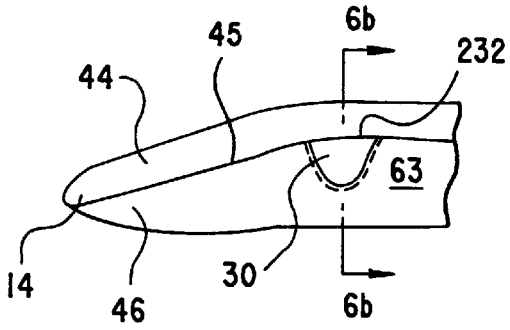
FIG. 6*a* is a side view of the index finger of the glove.

FIG. 6*a* shows the index finger receiving portion 14 including the top panel 44 and the bottom panel 46. The insert 30 is shown sewn on the side of the bottom panel 46. Bottom panel 46, including the long side 232 of the insert are sewn to the top panel 44 along line 45 forming the index finger receiving portion 14. This assembly is identical for both the right and left sides of the index finger receiving portion and for that matter, all of the other finger receiving portions.

Figure 6B:
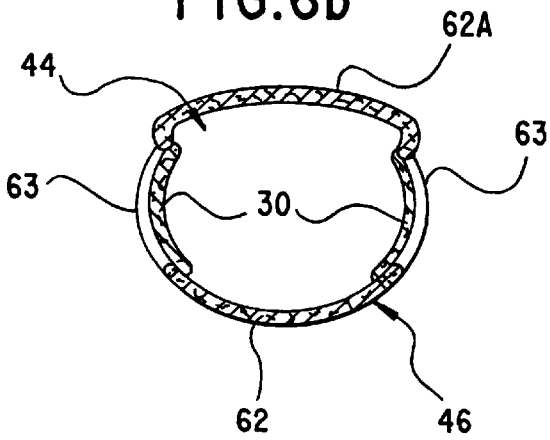
FIG. 6*b* is a cross-sectional view of the index finger of the glove taken along line 6*b*—6*b* of FIG. 6*a*.

FIG. 6*b* is a cut-away view taken along line 6*b*—6*b* of FIG. 6*a*. The intermediate portion 62*a* of the top panel 44 and the intermediate portion 62 of the bottom panel 46 are shown. Insert 30 is shown connected on both the right and left sides of the bottom panel 46. Element 63 on the right and left side are merely material located behind the insert 30, in communication with the proximal member 64 of the bottom panel 46. Again, this view would be substantially identical if taken along middle finger receiving portion, the ring finger receiving portion or the pinky finger receiving portion.

It is apparent from the above that the present invention accomplishes all of the objectives set forth by providing a glove with a right and a left insert on the finger receiving portion of the ring, middle, index and pinky finger which reduces stress on the portion of the glove immediately above the knuckles of the four fingers, thereby increasing the life of the glove.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A glove for covering a hand, said glove having a thumb receiving portion, an index finger receiving portion, a middle finger receiving portion, a ring finger receiving portion and a pinky receiving portion, said index receiving portion having a top panel and a bottom panel, said middle finger receiving portion having a top panel and a bottom panel, said ring finger having a top panel and a bottom panel, said pinky finger having a top panel and a bottom panel, said index finger bottom portion having an intermediate region, said middle finger bottom portion having an intermediate region, said ring finger bottom portion having an intermediate region, said pinky finger bottom portion having an intermediate region, said index finger bottom portion intermediate region having a right and a left side, said middle finger bottom portion intermediate region having a right and a left side, said ring finger bottom portion intermediate region having a right and a left side, said pinky finger bottom portion intermediate region having a right and a left side, said index finger bottom portion intermediate region right side including an insert, said index finger bottom portion intermediate region left side including an insert, said middle finger bottom portion intermediate region right side including an insert, said middle finger bottom portion intermediate region left side including an insert, said ring finger bottom portion intermediate region right side including an insert, said ring finger bottom portion intermediate region left side including an insert, said pinky finger bottom portion intermediate region right side including an insert, said pinky finger bottom portion intermediate region left side including an insert, said index finger top panel connected to said index finger bottom panel, said middle finger top panel connected to said middle finger bottom panel, said ring finger top panel connected to said ring finger bottom panel, said pinky finger top panel connected to said pinky finger bottom panel, whereby when said index finger receiving portion, said middle finger receiving portion, said ring finger receiving portion and said pinky finger receiving portion are closed about an object, the index finger top panel, the middle finger top panel, the ring finger top panel and the pinky top panel are not stretched.

2. A glove for covering a hand including four fingers and a thumb, each of the four fingers having a middle knuckle portion, said glove having a first finger receiving portion, said first finger receiving portion having a top side, a bottom side, a right side and a left side, said bottom side right side including an insert proximal the middle knuckle portion and said bottom side left side including an insert proximal the middle knuckle portion.

3. A glove as claimed in claim 2 wherein said glove further includes a second finger receiving portion, said second finger receiving portion having a top side, a bottom side, a right side and a left side, said bottom side right side including an insert proximal the middle knuckle portion and said bottom side left side including an insert proximal the middle knuckle portion.

4. A glove as claimed in claim 3 wherein said glove further includes a third finger receiving portion, said third finger receiving portion having a top side, a bottom side, a right side and a left side, said bottom side right side including an insert proximal the middle knuckle portion and said bottom side left side including an insert proximal the middle knuckle portion.

5. A glove as claimed in claim 4 wherein said glove further includes a fourth finger receiving portion, said fourth finger receiving portion having a top side, a bottom side, a right side and a left side, said bottom side right side including an insert proximal the knuckle portion and said bottom side left side including an insert proximal the knuckle portion.

6. A glove as claimed in claim 2 wherein said inserts are of a geometric configuration selected from the group consisting of a triangular element, a sinusoidal element, a half-circular element and a scalloped element.

7. A glove as claimed in claim 3 wherein said inserts are of a geometric configuration selected from the group consisting of a triangular element, a sinusoidal element, a half-circular element and a scalloped element.

8. A glove as claimed in claim 4 wherein said inserts are of a geometric configuration selected from the group consisting of a triangular element, a sinusoidal element, a half-circular element and a scalloped element.

9. A glove as claimed in claim 5 wherein said inserts are of a geometric configuration selected from the group consisting of a triangular element, a sinusoidal element, a half-circular element and a scalloped element.

* * * * *